US007210983B1

(12) United States Patent
Chien

(10) Patent No.: US 7,210,983 B1
(45) Date of Patent: May 1, 2007

(54) APPARATUS AND METHOD FOR GRINDING WORKPIECES

(75) Inventor: Yang-Chang Chien, Tu-Cheng (TW)

(73) Assignee: Hon Hai Precision Industry Co. Ltd, Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/453,482

(22) Filed: Jun. 14, 2006

(30) Foreign Application Priority Data

Nov. 11, 2005 (CN) ..... 2005 1 0101202

(51) Int. Cl.
*B24B 1/00* (2006.01)

(52) U.S. Cl. ..... 451/42; 451/44; 451/178

(58) Field of Classification Search ..... 451/54, 451/51, 42–44, 47, 147, 148, 160, 240, 246, 451/67, 255, 256, 272, 273, 274, 277; 156/153–155
See application file for complete search history.

(56) References Cited

U.S. PATENT DOCUMENTS 135,131 A * 1/1873 Kohler ..... 451/273
4,331,452 A * 5/1982 Causey et al. ..... 451/67
5,087,307 A * 2/1992 Nomura et al. ..... 156/154
2006/0089086 A1* 4/2006 Pedersen ..... 451/8

* cited by examiner

*Primary Examiner*—Dung Van Nguyen
(74) *Attorney, Agent, or Firm*—Jeffrey T. Knapp

(57) ABSTRACT

An exemplary method for grinding workpieces is provided. Firstly, a plurality of workpieces (18) are bonded together. The bonded workpieces have a central axis (181). Secondly, a grinding wheel (10) is provided. The grinding wheel has a rotating axis (100), and the rotating axis is perpendicular to the central axis. Thirdly, the bonded workpieces are rotated around the central axis. Fourthly, the grinding wheel is placed near to the bonded workpieces, and the rotating axis and the central axis are separated by a predetermined perpendicular distance. Finally, the grinding wheel is rotationally moved along the central axis to grind the workpieces whilst maintaining the predetermined distance between the rotating axis and the central axis.

15 Claims, 1 Drawing Sheet

APPARATUS AND METHOD FOR GRINDING WORKPIECES

TECHNICAL FIELD

The present invention generally relates to apparatus and methods for grinding workpieces and, more particularly, to an apparatus and a method for cylindrically grinding workpieces.

BACKGROUND

Usually, optical elements such as camera lenses and spectacles are in used in cylindrical form. However, original optical workpieces (i.e. lens blanks) are most easily manufactured in the form of a square. Therefore, these original optical workpieces have to be cylindrically ground before use.

A typical example of a contemporary cylindrical grinding apparatus is a centraling apparatus. The centraling apparatus typically includes a pair of holders for holding the original workpiece, where each holder has a hollow chamber communicating with a surface of the holder. The holder can hold the workpiece on its surface by using an air pump creating suction in the hollow chamber, a grinding wheel is then used to cylindrically grind the workpiece. However, the centraling apparatus can only cylindrically grind one workpiece at a time.

FIG. 2 shows a method for cylindrically grinding more than one workpiece 50 at a time. The workpieces 50 are bonded together using ultraviolet adhesive. Then a grinding wheel 40 is used to grind the bonded workpieces 50 into a cylindrical shape. During the grinding process, the grinding wheel grinds the bonded workpieces 50 along an X direction and a Z direction. However, when grinding along the X direction, the grinding wheel needs to run along the X direction many times because the grinding wheel only contacts the workpieces over a small area.

Therefore, a method for cylindrically grinding workpieces which can overcome the above-described problems is desired.

SUMMARY

In one aspect, a method for grinding workpieces is provided. Firstly, a plurality of bonded workpieces are positioned. The bonded workpieces have a central axis. Secondly, a grinding wheel is placed near to the workpieces. The grinding wheel has a rotating axis perpendicular to the central axis. The rotating axis and the central axis are separated by a predetermined perpendicular distance. Thirdly, the bonded workpieces are rotated around the central axis. Finally, the grinding wheel is rotated around the rotating axis, whilst maintaining the predetermined distance between the rotating axis and the central axis, and moved in a direction parallel to the central axis to grind the workpieces.

In another aspect, an apparatus for grinding workpieces is provided. The apparatus includes a clamp mechanism, a grinding wheel, and a driving mechanism. The clamp mechanism is configured for holding a stack of workpieces in a manner that the workpieces are rotatable around a central axis. The grinding wheel has a rotating axis perpendicular to the central axis. The driving mechanism is connected to the grinding wheel for rotating the grinding wheel around the rotating axis and moving the grinding wheel in a direction parallel to the central axis at the same time.

Other advantages and novel features will become more apparent from the following detailed description when taken in conjunction with the accompanying drawings.

BRIEF DESCRIPTION OF THE DRAWINGS

Many aspects of the method for cylindrically grinding workpieces can be better understood with reference to the following drawings. The components in the drawings are not necessarily drawn to scale, the emphasis instead being placed upon clearly illustrating the principles of the present method for cylindrically grinding workpieces. Moreover, in the drawings, like reference numerals designate corresponding parts throughout the several views.

DETAILED DESCRIPTION OF THE EMBODIMENT

Figure 1:
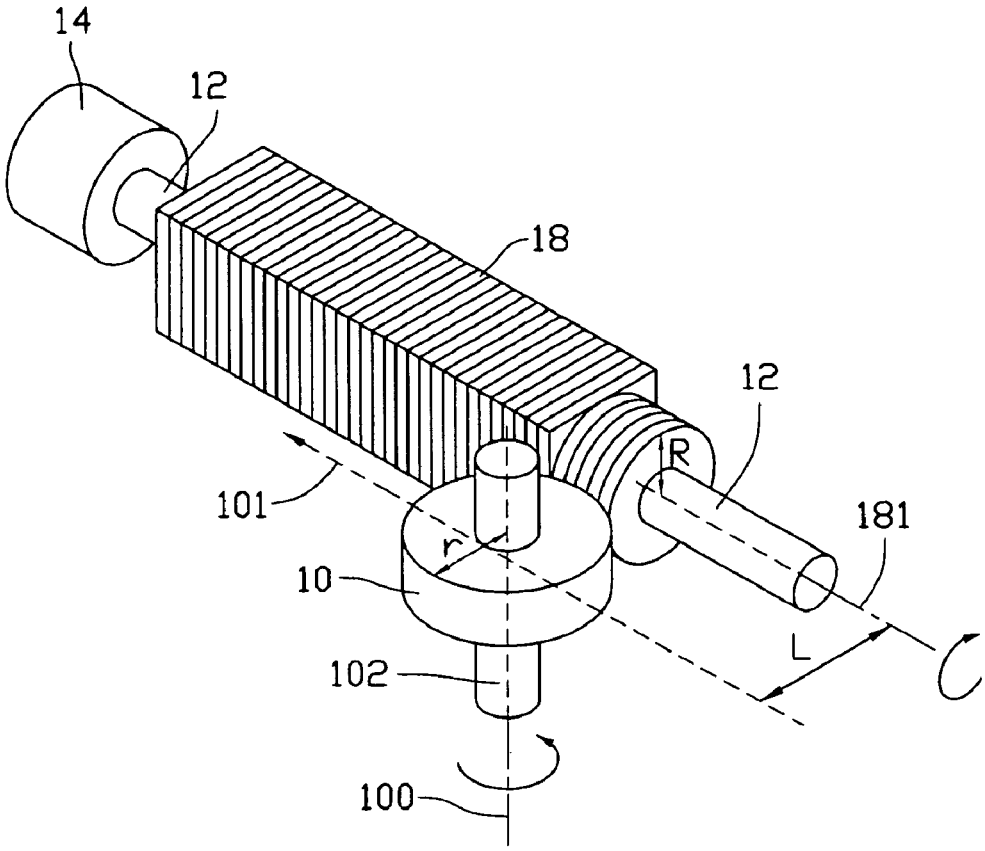
FIG. 1 is a schematic view of a method for cylindrically grinding workpieces in accordance with a preferred embodiment.
Figure 2:
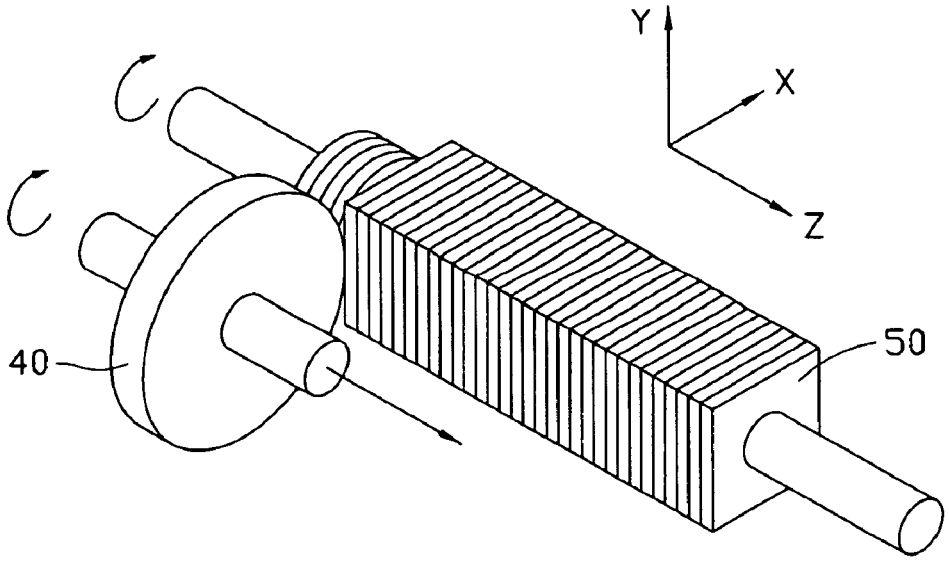
FIG. 2 (RELATED ART)
FIG. 2 is a schematic view of a method for cylindrically grinding workpieces from the related art.

Referring to FIG. 1, in a preferred embodiment, a grinding wheel 10 and two clamps 12 are used for cylindrically grinding workpieces 18. The clamps 12 are used for holding the workpieces 18, and the grinding wheel 10 is used for grinding the workpieces 18. The grinding wheel 10 is connected to a driving mechanism 102 for rotating and moving the grinding wheel 10. One of the clamps 12 is connected to a rotating device 14 for rotating the clamps 12 and the workpieces 18.

The workpieces 18 can be optical elements having a non-cylindrical shape. In this exemplary embodiment, the workpieces 18 are in substantially square form. The workpieces 18 can be bonded together using hydrolysable ultraviolet adhesive. The bonded workpieces 18 have a central axis 181, and the bonded workpieces 18 can be rotated using the rotating device 14. In this embodiment, the rotating device 14 can be a rotary motor.

In this embodiment, the grinding wheel 10 is cylindrical in shape, and has a radius r. The grinding wheel 10 has a rotating axis 100 perpendicular to the central axis 181 of the workpieces 18, and the grinding wheel 10 can be rotated around the rotating axis 100 by the driving mechanism 102. In this embodiment, the driving mechanism 102 is a motor.

Referring to FIG. 1, an exemplary method for cylindrically grinding workpieces 18 includes the steps of:

(1) a stack of workpieces 18 are bonded together using hydrolysable ultraviolet adhesive;

(2) the bonded workpieces 18 are held in the clamps 12, and the bonded workpieces 18 have a central axis 181;

(3) the grinding wheel 10 is placed near to the bonded workpieces 18, the rotating axis 100 is perpendicular to the central axis 181, and the rotating axis 100 and the central axis 181 are separated by a predetermined perpendicular distance L;

(4) the bonded workpieces 18 are rotated around the central axis 181 by the rotating device 14;

(5) maintaining the predetermined distance L, the grinding wheel 10 is rotationally moved along a moving path 101 parallel to the central axis 181 to grind the workpieces 18 into cylindrical shape; and, (6) the cylinder shape workpieces 18 are placed in a water container, and the hydrolysable ultraviolet adhesive is removed using a ultrasonic device so as to obtain a plurality of desired workpieces.

In step (5), the cylinder shape workpieces 18 have a predetermined radius R. The predetermined distance L is equal to the radius r of the grinding wheel 10 plus the radius R of the cylindrical workpieces 18. Understandably, the step (4) can be performed either before or after step (3).

It is believed that the present embodiments and their advantages will be understood from the foregoing description, and it will be apparent that various changes may be made thereto without departing from the spirit and scope of the invention or sacrificing all of its material advantages, the examples here before described merely being preferred or exemplary embodiments of the invention.

What is claimed is:

1. A method for grinding workpieces, comprising the steps of:

bonding a plurality of workpieces, the bonded workpieces having a central axis;

providing a grinding wheel, the grinding wheel being cylindrical in shape and having a rotating axis and a radius, the rotating axis being perpendicular to the central axis;

rotating the bonded workpieces around the central axis;

placing the grinding wheel near to the bonded workpieces, the rotating axis and the central axis being separated by a predetermined perpendicular distance; and maintaining the predetermined distance between the rotating axis and the central axis, and rotationally moving the grinding wheel in a direction parallel to the central axis to grind the workpieces, the workpieces being ground into a cylindrical shape, the cylindrical shaped workpieces having a radius associated therewith, the predetermined perpendicular distance being equal to the radius of the cylindrical shaped workpieces plus the radius of the grinding wheel.

2. The method as claimed in claim 1, wherein the workpieces are in square form.

3. The method as claimed in claim 1, wherein the workpieces are bonded using a hydrolysable ultraviolet adhesive.

4. The method as claimed in claim 1, wherein the grinding wheel is rotated and moved by a driving mechanism.

5. The method as claimed in claim 4, wherein the driving mechanism is a motor.

6. The method as claimed in claim 1, wherein the bonded workpieces are held using two clamps.

7. The method as claimed in claim 6, wherein one of the clamps is connected to a rotating device.

8. A method for grinding workpieces, comprising the steps of:

positioning a plurality of bonded workpieces having a central axis;

placing a grinding wheel near to the workpieces, the grinding wheel being cylindrical in shape and having a radius, the grinding wheel having a rotating axis perpendicular to the central axis, the rotating axis and the central axis being separated by a predetermined perpendicular distance;

rotating the bonded workpieces around the central axis; and maintaining the predetermined distance between the rotating axis and the central axis and rotationally moving the grinding wheel in a direction parallel to the central axis to grind the workpieces, the workpieces being ground into a cylindrical shape, the cylindrical shaped workpieces having a radius associated therewith, the predetermined perpendicular distance being equal to the radius of the cylindrical shaped workpieces plus the radius of the grinding wheel.

9. The method as claimed in claim 8, wherein the grinding wheel is rotated and moved by a driving mechanism.

10. The method as claimed in claim 8, wherein the bonded workpieces are held using two clamps.

11. An apparatus for grinding workpieces, the workpieces being ground into a cylindrical shape thereby, the cylindrical shaped workpieces having a radius, the apparatus comprising:

a clamp mechanism configured for holding a stack of workpieces in a manner that the workpieces are rotatable around a central axis;

a cylindrically-shaped grinding wheel having a rotating axis perpendicular to the central axis and a radius, the rotating axis and the central axis being separated by a predetermined perpendicular distance, the predetermined distance being equal to the radius of the cylindrical shaped workpieces plus the radius of the grinding wheel; and a driving mechanism connected to the grinding wheel for rotating the grinding wheel around the rotating axis and moving the grinding wheel in a direction parallel to the central axis at the same time.

12. The apparatus as claimed in claim 11, further comprising a rotating device connected to the clamp mechanism for rotating the clamp mechanism around the central axis.

13. The apparatus as claimed in claim 12, wherein the rotating device is a rotary motor.

14. The apparatus as claimed in claim 11, wherein the clamp mechanism includes two clamps for sandwiching the workpieces therebetween.

15. The apparatus as claimed in claim 11, wherein the driving mechanism is a motor.

* * * * *